US007484938B2

(12) United States Patent
Allen

(10) Patent No.: US 7,484,938 B2
(45) Date of Patent: Feb. 3, 2009

(54) ELECTRONIC CONTROL FOR POOL PUMP

(76) Inventor: Stephen D Allen, 1900 W. Chandler Blvd., Suite 15-264, Chandler, AZ (US) 85224

( * ) Notice: Subject to any disclaimer, the term of this patent is extended or adjusted under 35 U.S.C. 154(b) by 491 days.

(21) Appl. No.: 11/121,400

(22) Filed: May 3, 2005

(65) Prior Publication Data

US 2005/0260079 A1 Nov. 24, 2005

Related U.S. Application Data

(60) Provisional application No. 60/573,404, filed on May 21, 2004.

(51) Int. Cl.
*F04B 43/12* (2006.01)
*F04B 49/06* (2006.01)
*F04B 49/00* (2006.01)

(52) U.S. Cl. ..... 417/53; 417/12

(58) Field of Classification Search ..... 210/743, 210/739, 742, 138, 69.1, 96.1, 88, 89, 97, 210/139, 143, 85, 90; 417/12, 32, 53, 18
See application file for complete search history.

(56) References Cited

U.S. PATENT DOCUMENTS 4,676,914 A * 6/1987 Mills et al. ..... 210/741
5,422,014 A * 6/1995 Allen et al. ..... 210/743
6,079,950 A 6/2000 Seneff
6,228,272 B1 * 5/2001 Gola ..... 210/742

* cited by examiner

*Primary Examiner*—Devon C Kramer
*Assistant Examiner*—Alexander B Comley
(74) *Attorney, Agent, or Firm*—Etherton Law Group, LLC; Sandra L. Etherton; Benjamin D. Tietgen

(57) ABSTRACT

An electronic pool pump timer that controls the run time or the pump for a period of time each day depending on the date. In the preferred embodiment, the user enters the historical daily maximum and minimum pump run times for the specific pool and the system calculates the required time the pump will run on a given day. The customized run time is thus calculated as a function of the date and the minimum and maximum run times for a given pool. The system then self-adjusts the run time each day as necessary. The device comprises a data input means, a display, memory, and a controller. It may also include a manual override to allow the user to turn the pump on at any time. The device is connected to the pump motor. The device is connected to a power supply and may also include a battery back-up in the event of a power outage. To prevent the pool from freezing. the system may also include an air temperature sensor that triggers pump operation when the ambient air is below a given temperature.

1 Claim, 7 Drawing Sheets

ELECTRONIC CONTROL FOR POOL PUMP

CROSS-REFERENCE TO RELATED APPLICATIONS

This application claims the benefit of U.S. Provisional Application No. 60/573,404 filed May 21, 2004.

FIELD OF THE INVENTION

The invention relates to electronic control for a pool pump. In particular, the invention relates to a method and apparatus for electronically controlling the operating time of a pool pump.

BACKGROUND TO THE INVENTION

Conventional swimming pools and spas include a water recirculation system comprising a pump and a filter for filtering particles and debris from the pool or spa water. The water is also usually chemically treated to kill bacteria in the water. The rate of bacteria growth in the water is a function of, among other factors, water temperature, and therefore at lower temperatures the pump and pool filter can be run for a shorter time than is required at higher temperatures. However, some households maintain the same run time for the pool pump throughout the year, thus wasting energy and money. A typical 7.8A pool pump is driven at 220V and may run for 8 hours per day during the summer. Assuming current energy cost of 10 cents per kWh, a single pump costs $1.37 to run per day. Often systems comprise two pumps resulting in an expenditure of about $82 per month.

Most pool pumps are controlled by an electronic or electromechanical timer. The timer has the function of turning the pool pump "on" and "off" at designated times of the day to filter contaminants from the pool water. The "run-time" is the difference between the "on" and "off" times when the pool filter motor is running (consuming energy). A "constant-duty" timer turns the filter pump on and off at the same time every day, irrespective of the season. While some consumers adjust the run time of their constant-duty timer in the winter, and again in the spring, many forget to adjust the run time, resulting in running the pump unnecessarily. As an alternative, some households merely run the pool pump on a constant reduced run time during the winter months. Although this approach reduces the energy consumption to an extent, further savings could be made. Furthermore, some days during the winter months can be warmer than expected resulting in the pool pump being run for an insufficient duration allowing bacteria to proliferate. Conversely, during the summer months, cooler than normal days can occur resulting in unnecessarily long run times. It would be desirable to automatically adjust the timer to precisely controls run time throughout the year, with measurable savings.

An example of a pool recirculation control system is disclosed in U.S. Pat. No. 6,079,950 in the name of Seneff. This system includes one or two temperature sensors that detect the temperature of the water in the pool or the temperature of the recirculated water. This requires installing a temperature sensor that is remote from the timer circuits and installing the accompanying transmission system, either with wires or wirelessly with radio frequency. A controller operates one of a number of timer circuits that run the pump and filter for a duration in accordance with the sensed temperature. A first timer circuit runs the pump for a longer predetermined time period when the water temperature is sensed above a predetermined threshold. A second timer circuit runs the pump for a shorter predetermined time period when the water temperature is sensed below the predetermined threshold. A more sophisticated version of the system is disclosed that operates a single timer circuit for a run time that is variably controlled to be directly proportional to the sensed water temperature, i.e. longer run times for higher temperatures.

While the pool recirculation control system of U.S. Pat. No. 6,079,950 reduces the run time of the pool filter and pump in accordance with water temperature, the requirement of multiple temperature sensors and multiple timing circuits results in fairly complex system that is costly to produce and purchase and difficult to install. Homeowners prefer to handle daily maintenance like setting run times and adding chemicals without having to call a pool professional. It is desirable, then, that pool technology be simple and cheap enough for homeowners to install and use it without calling in a pool professional. Furthermore, with the number of existing pools, it would be desirable to upgrade existing pool technology by retrofitting existing systems, as opposed to installing entirely new ones.

Therefore, it is an object of the present invention to minimize the energy consumption of pool pumps and filters than the aforementioned prior art while maintaining the quality of the pool water. It is a further object to provide a device that can be retrofitted to existing systems and operated by a homeowner without resort to a pool professional.

SUMMARY OF THE INVENTION

The present invention is an electronic pool pump timer that controls the run time of the pump for a period of time each day depending on the date. In the preferred embodiment, the user enters the historical daily maximum and minimum pump run times for the specific pool and the system calculates the required time the pump will run on a given day. The customized run time is thus calculated as a function of the date and the minimum and maximum run times for a given pool. The system then self-adjusts the run time each day as necessary.

The device comprises a data input means, a display, memory, and a controller. It may also include a manual override to allow the user to turn the pump on at any time. The device is connected to the pump motor. The device is connected to a power supply and may also include a battery back-up in the event of a power outage. To prevent the pool from freezing, the system may also include an air temperature sensor that triggers pump operation when the ambient air is below a given temperature.

DETAILED DESCRIPTION OF THE INVENTION

Figure 1:
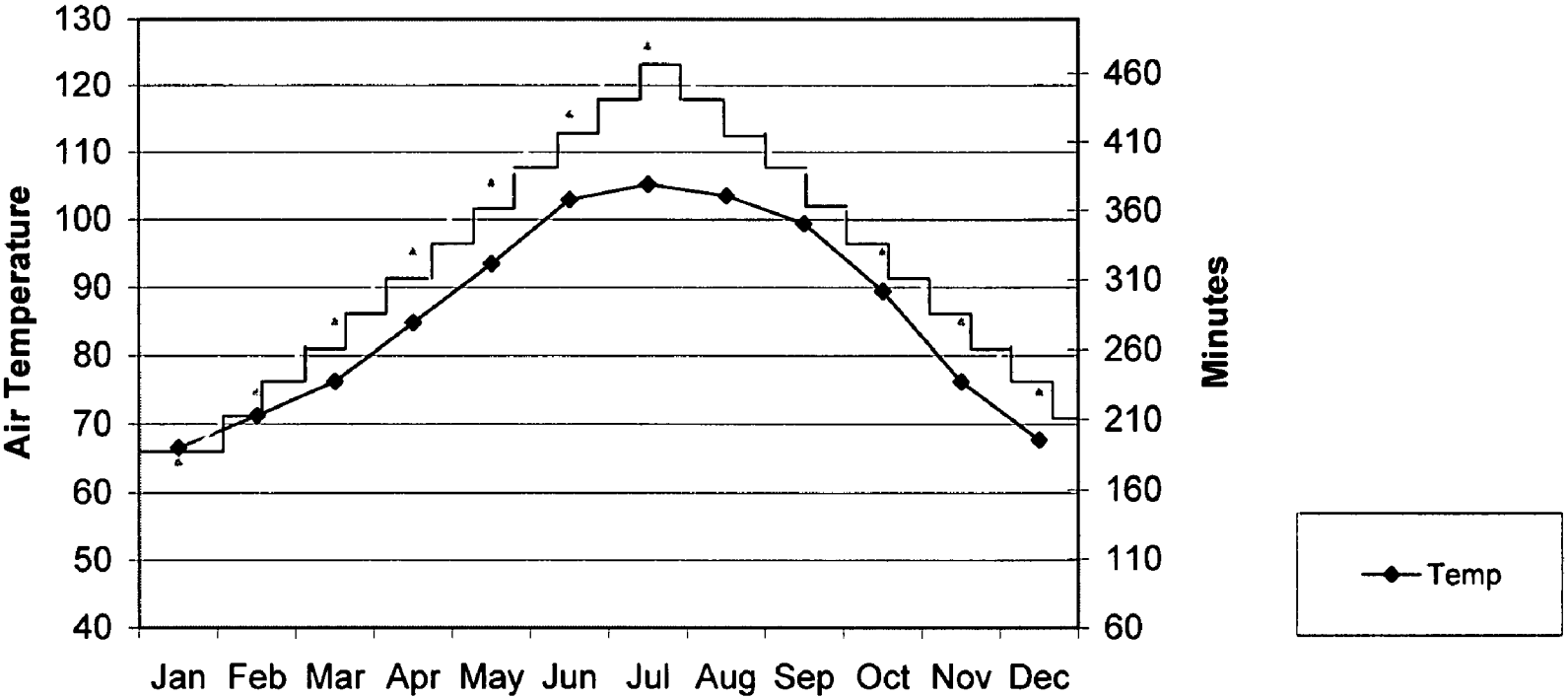
FIG. 1 is a chart illustrating the historical average air temperatures in Phoenix and the operating time of a pool pump controlled under the preferred embodiment of the present invention.

Air temperatures are generally cooler in the winter and warmer in the summer, although the variance between the minimum and maximum temperatures may vary, depending on the locale. FIG. 1 illustrates a curve 7 of the historical average air temperature for Phoenix, Ariz., where the x-axis is the date and the left y-axis is the air temperature in degrees Fahrenheit. FIG. 1 also illustrates a preferred curve 8 of pool pump run times throughout the year. The right y-axis shows run times in minutes.

The present invention is an electronic pool pump timer that controls the run time of the pump for a period of time each day depending on the date to optimize the efficiency of the pump and thereby reduce energy expenditures. To maximize efficiency, the run time curve takes into account the factors that affect the amount of time the pump needs to be run to maintain optimal water quality, such as air temperature, number of bathers (and the degree to which they are slathered in sunscreen), sunlight, environmental debris, type and amount of bacteria and algae, surface leaching, and water chemical composition.

For some cases, highest efficiency would be achieved by adjusting the run time daily. In the preferred embodiment, however, it has been determined that efficiency is optimized when run time curve approximates the air temperature curve, which is substantially a function of the date. Thus, the run time is adjusted periodically, depending on the date. Specifically, the preferred embodiment of the present invention reduces the run time 10% from the maximum run time twice a month beginning July 15th to eventually reach the minimum run time at the beginning of December. See FIG. 1. The run time is then increased 10% twice a month beginning February 1 st. Successive run time adjustments are made on the 1st and 15th of each month. This results in a stepped run time curve 8 that is substantially an inverted v-shape. The periodic change in run time is referred to herein as the "run time delta" and the equation used to calculate the run time is referred to as the "run time equation." For example, if the default maximum and minimum run times for Phoenix are 18 hours and 1 hour, respectively, the run time delta is 10% of 17 hours, or 102 minutes. So, the run time will change 102 minutes on the $1^{st}$ and $15^{th}$ of each month.

The preferred algorithm can be tailored more specifically to a given pool by entry of user-specified minimum and maximum run times specific to the pool. That is, while the algorithm will default to default maximum and minimum run times as pre-programmed into the system, the user can enter user-specified max and min run times for the algorithm to work with, to further customize the run times. These user-specified limits are factored into the function for determining the run time for a specific day. For example, if the user-specified maximum and minimum run times for a given pool are 8 hours and 3 hours, respectively, the run time delta is 10% of 5 hours, or 30 minutes. So, the run time will change 30 minutes on the $1^{st}$ and $15^{th}$ of each month. Run time curve 8 on FIG. 1 shows run times as a function of the date, assuming a maximum daily run time of 8 hours, and a minimum daily run time of 3 hours.

Alternative embodiments of the present invention may take into account other factors that affect the amount of time the pump needs to be run to maintain optimal water quality. For example, bacterial growth rate is not a linear function of temperature, but more like a Gaussian distribution. Filter efficiency, in contrast, behaves as a decaying exponential function. Other factors or combinations thereof may contribute to the optimum run time. For example, a particular climatic region or location, such as city, town, suburb, zip code or the like, may have a unique temperature pattern throughout the year. The run time equation, being a function of the date, can be customized to the seasons of the year for each climatic region. As a result, the run time equation may produce a Gaussian, parabolic or other shaped curve.

While the preferred embodiment changes the run time twice a month, the run time can be changed as often as daily. FIG. 2 illustrates an alternate embodiment in which the run time is changed daily, producing a relatively smooth curve. Again curve 7 shows the historical average air temperature for Phoenix, Ariz. and curve 9 shows the smoother, substantially v-shaped curve resulting from a daily change in run time.

Figure 2A:
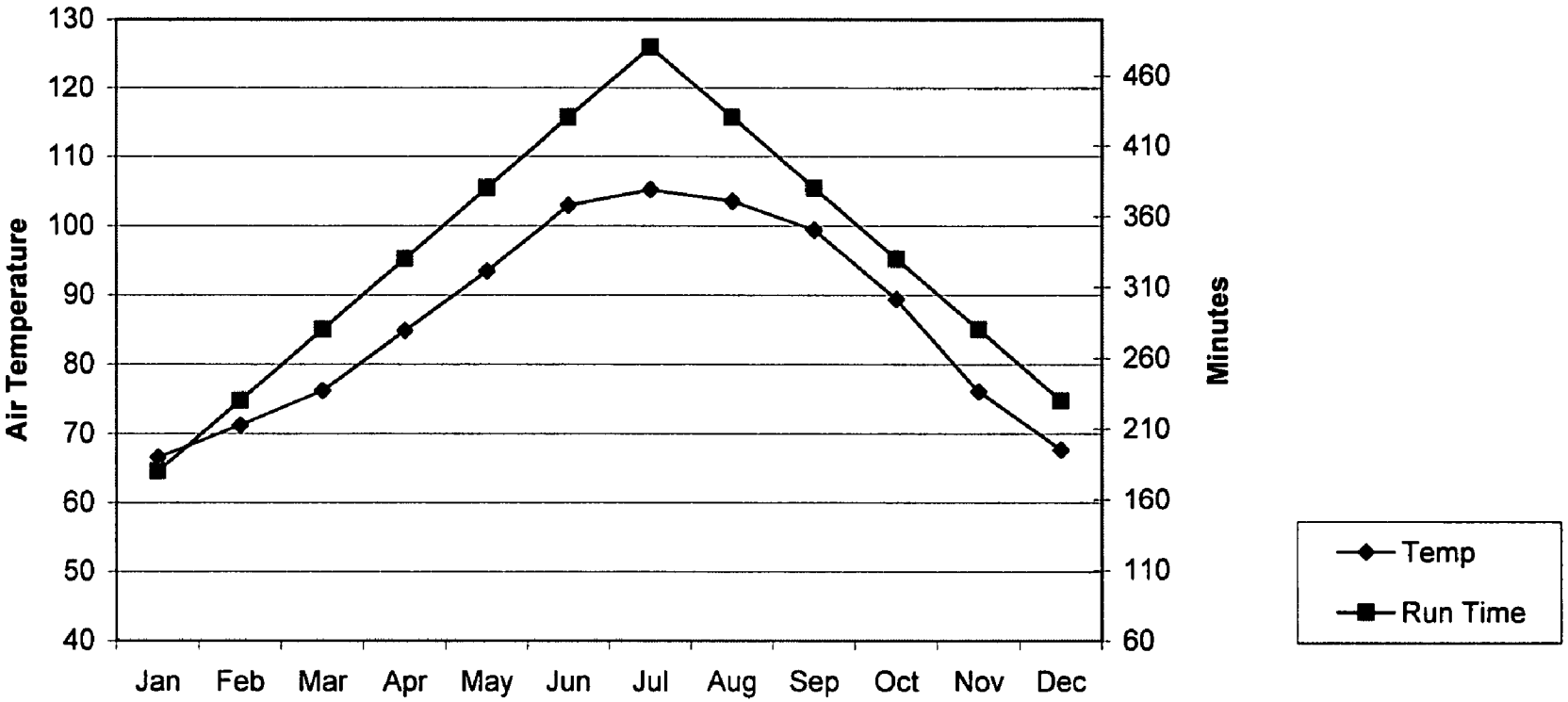
FIG. 2*a* is a chart illustrating the historical average air temperatures in Phoenix and the operating time of a pool pump controlled under an alternate embodiment of the present invention.
Figure 2B:
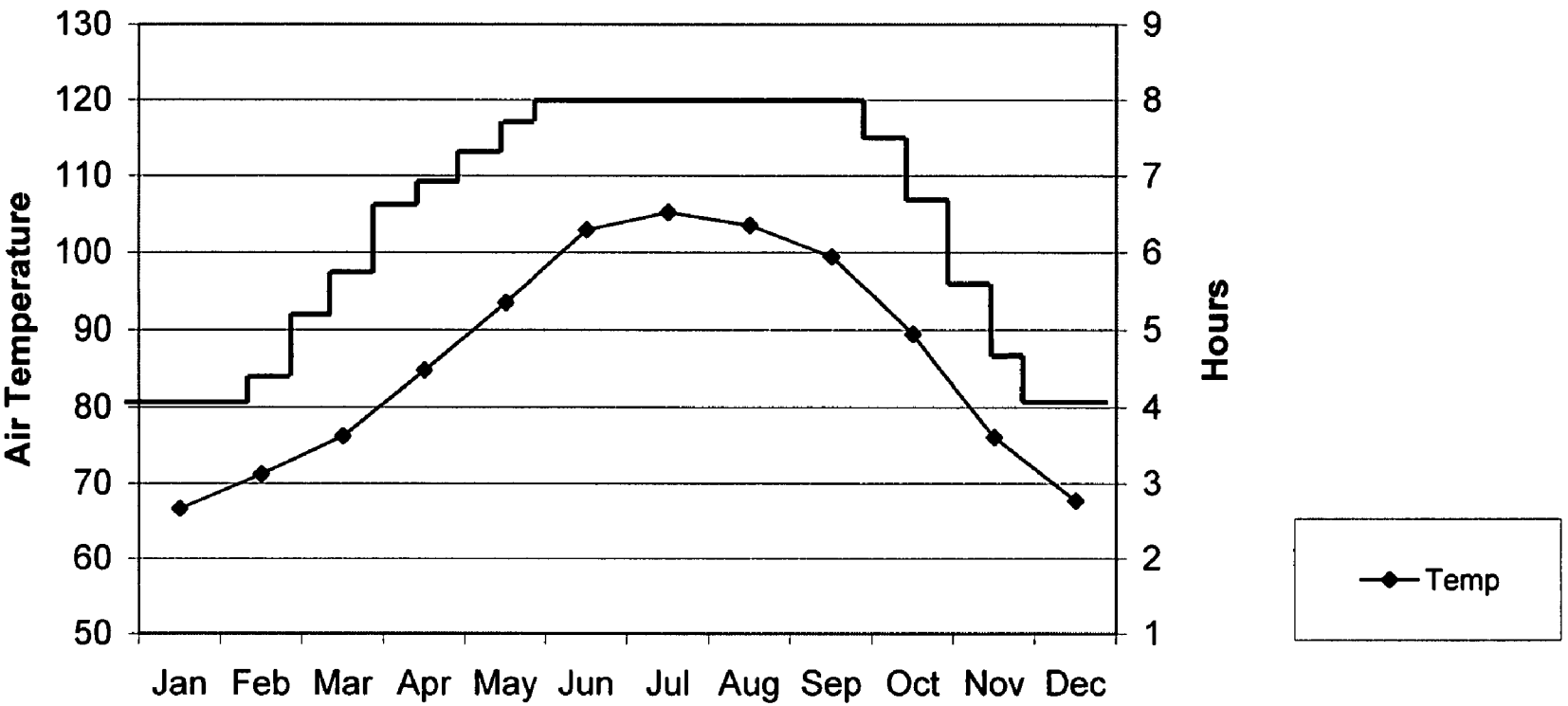
FIG. 2*b* is a chart illustrating the historical average air temperatures in Phoenix and the operating time of a pool pump controlled under another alternate embodiment of the present invention.

FIG. 2*a* illustrates another alternate embodiment in which the run time is determined by the date and the run times produce a Gaussian-like curve with flattened crest and trough, indicating relatively constant run time during the summer and winter, respectively.

Figure 3:
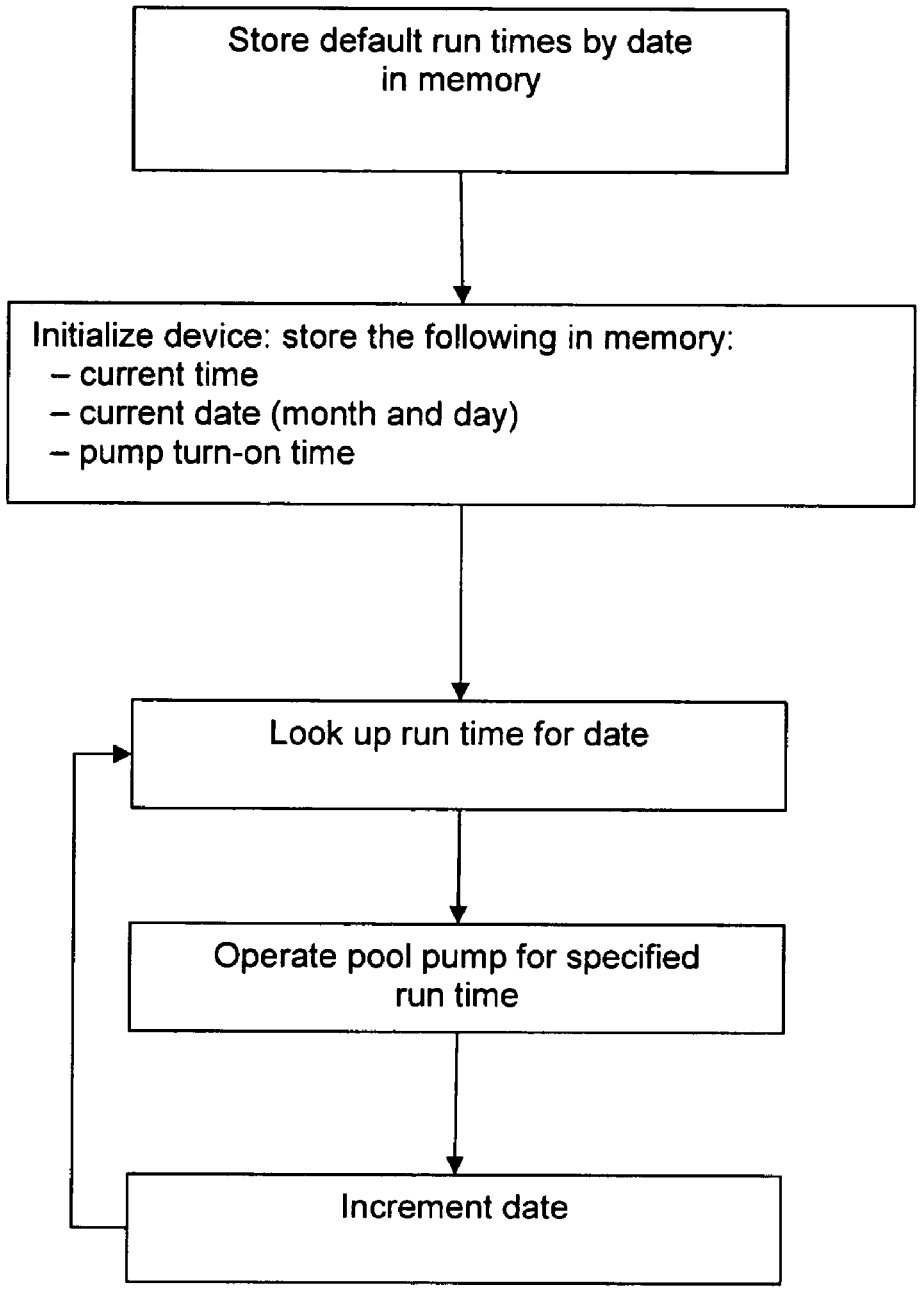
FIG. 3 is a flowchart of the present invention.

FIG. 3 is a flow chart of the process. Default run times are stored in memory in association with each respective date, preferably in a look-up table. The device is initialized with the current time and current date (month and day), as well as the time the pump should turn on for its daily cycle. The run time is obtained from the look-up table for a given date and the pump is run accordingly. The next day, the run time is again obtained from the look-up table for the then-current date, and the pump is run accordingly.

Figure 4:
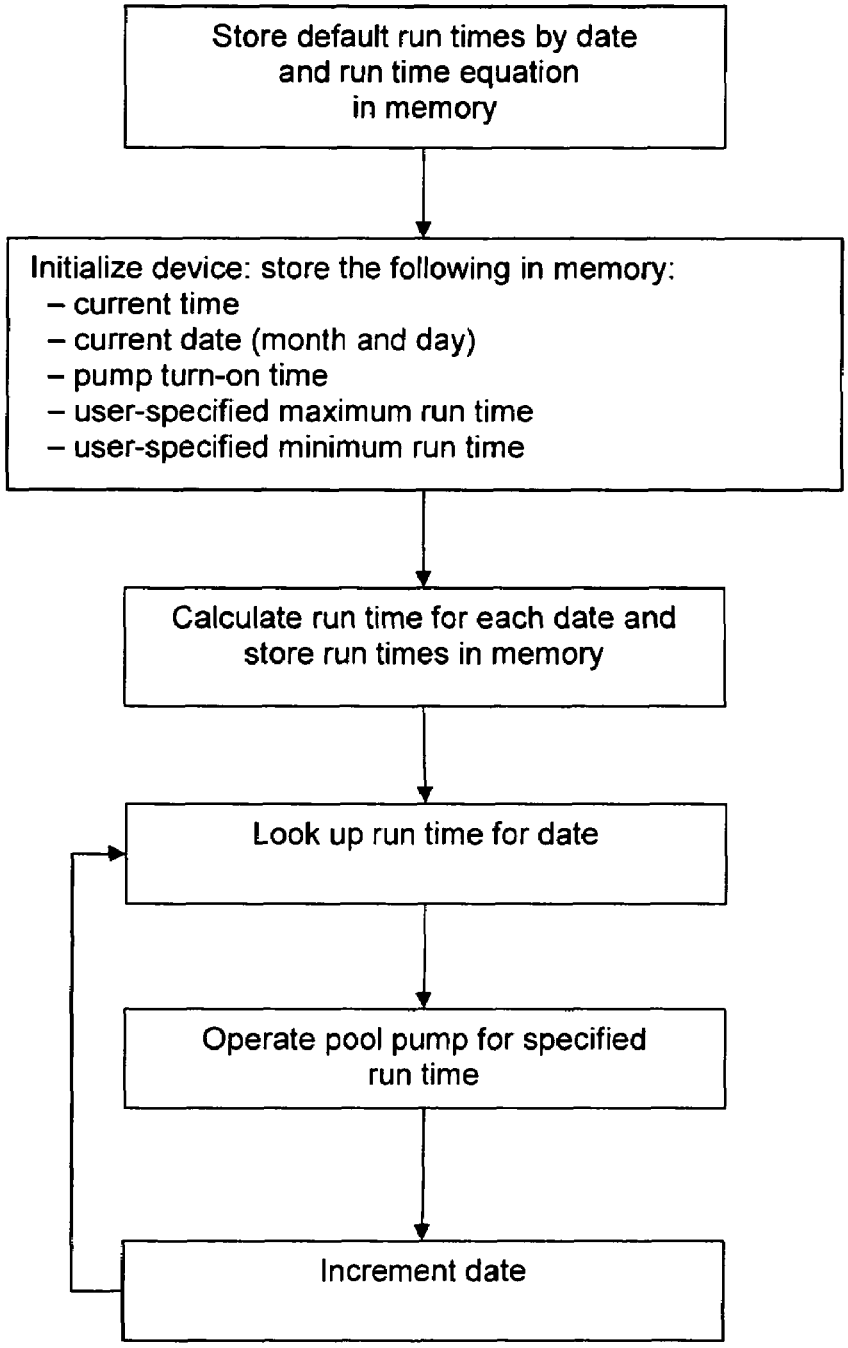
FIG. 4 is a flowchart of the preferred method of the present invention.

FIG. 4 is a flow chart of the preferred embodiment of the process. Default run times are stored in memory in association with each respective date. The run time equation is also stored in memory. The device is initialized with the current time and current date (month and day), as well as the time the pump should turn on for its daily cycle. Off peak hours are preferred. In addition, the user-specified maximum run time and minimum run time are stored in memory. The run time is calculated for each date from the run time equation, as a function of the date, the maximum run time, and the minimum run times. The run times are stored in memory. The pump is run accordingly for the current date, starting at the desired pump turn-on time. The next day, the run time is again obtained from the look-up table for the then-current date, and the pump is run accordingly.

Figure 5:
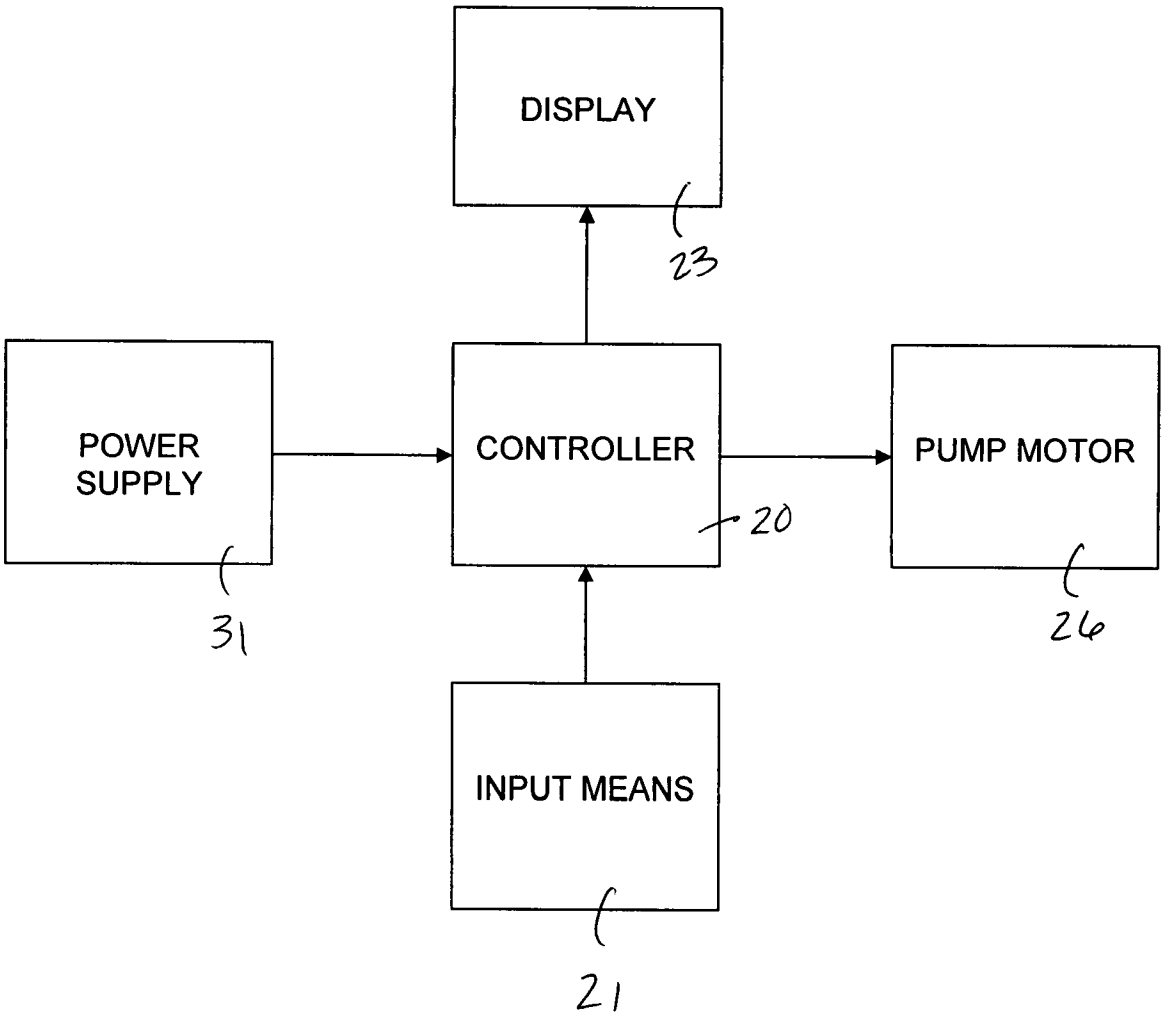
FIG. 5 is a block diagram of the device for electronically controlling the operating time of a pool pump.
Figure 6:
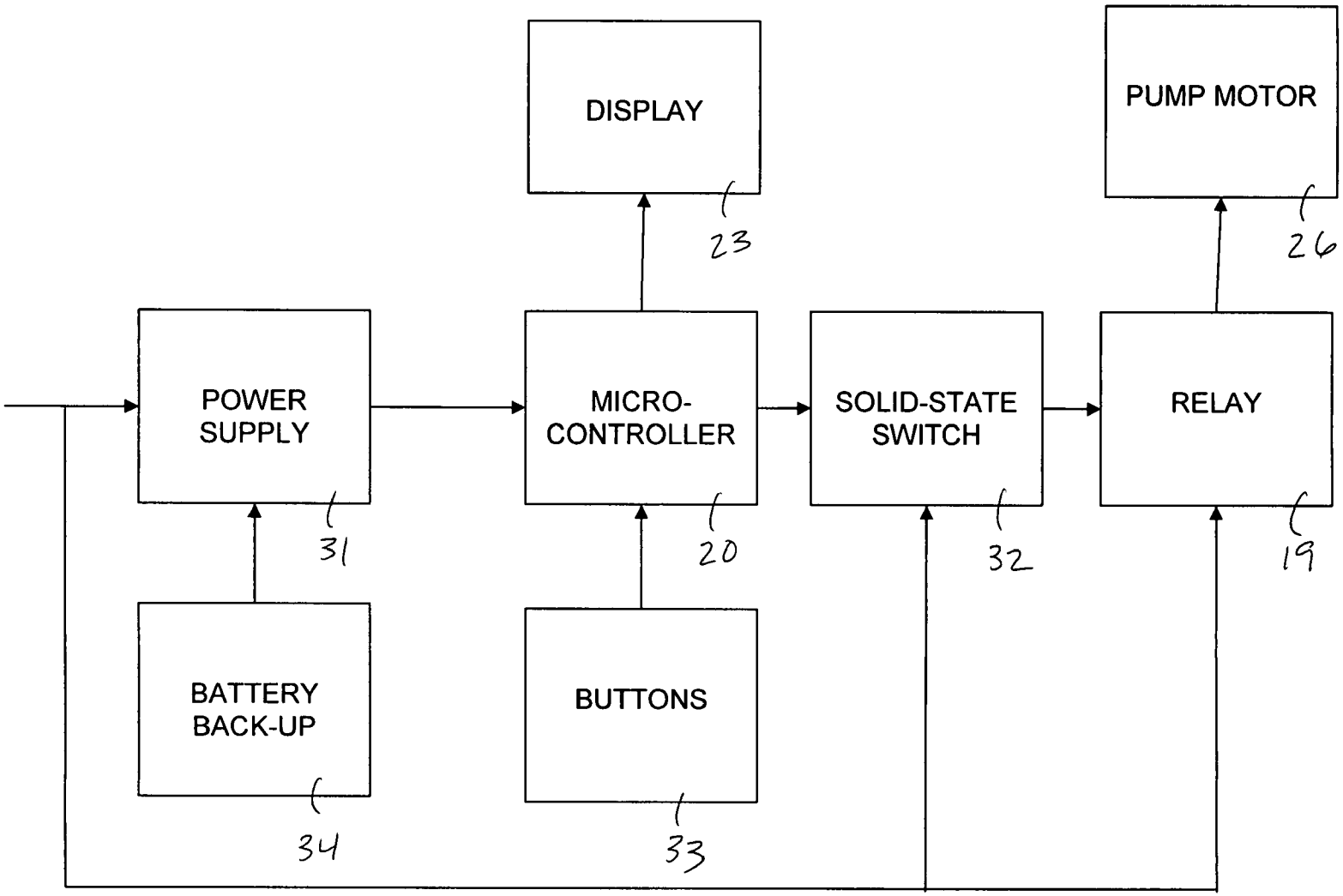
FIG. 6 is a block diagram of the preferred embodiment of the device for electronically controlling the operating time of a pool pump.

The device used to implement the present invention 10 comprises a controller 20, which further comprises a processor, memory and timing means. Controller 20 is preferably in the form of a microcontroller, shown as a single module in FIGS. 5 and 6, however it will be appreciated that the controller 20, processor, memory and timing means may be discrete components in communication with each other. The memory may be any suitable memory known in the art such as a ROM or EPROM. Controller 20 is connected to the pump to activate it and deactivate it. Preferably the controller is connected to the pump motor through a solid-state switch 32 and pump relay 19, which activate and deactivate the pump 26. The device may also include a manual override to allow the user to turn the pump on at any time.

User input means 21, such as a keypad, touch-sensitive screen, or mechanical dials, are coupled to the controller 20 to enable a user to enter data. The preferred embodiment uses two toggle buttons 33 for all user entries. These "change" and "enter" buttons are pressed in cooperation to set user-defined parameters, namely the current time, date, or pump turn-on time, which can also function as the manual override. The device may also have an input port, such as USB or RJ-11, which would allow a connection to a computer or to the internet. This type of connection is envisioned for use by the pool professional for storing default run times and the run time equations in memory without having to manually enter the data.

Output means 23, such as a display, is also coupled to controller 20 for displaying information to the user. Mains power supply 25 is provided for the pump relay 19 and pump 26. A low voltage supply 31 may be taken from the mains supply 25 by any suitable means known in the art for the controller 20 and display 23. The device may also include a battery back-up 34 in the event of a power outage.

Many existing pools house the prior art control circuitry in a metal enclosure outside near the pool pump and relatively near the pool. As is known in the art, that circuitry is supplied with a power supply, load and ground wires. The present device can be installed in the existing enclosure simply by removing the old device and attaching the present device to the existing wires. The prior art enclosure provides an additional benefit: it has good thermal conductivity and therefore the ambient air temperature inside the enclosure closely approximates the air temperature outside the enclosure and surrounding the pool. This enables the present system to deploy a freeze-prevention feature in which the device includes an air temperature sensor that triggers pump operation when the ambient air is below a given temperature.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A method for controlling the operating time of a pool pump comprising:

a) storing the current time, month, and day;

b) storing a default maximum run time and a default minimum run time;

c) storing a user-specified maximum run time and a user-specified minimum run time;

d) after storing the default maximum run time, the default minimum run time, the user-specified maximum run time, and the user-specified minimum run time, calculating a run time for each day as a function of:

i. the default maximum run time;

ii. the default minimum run time;

iii. the user-specified maximum run time;

iv. the user-specified minimum run time; and e) operating the pool pump each day for the calculated run time.

* * * * *